US008769840B2

(12) United States Patent
Dondurur et al.

(10) Patent No.: US 8,769,840 B2
(45) Date of Patent: Jul. 8, 2014

(54) RECIRCULATING DRYER

(75) Inventors: Memhet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 228 days.

(21) Appl. No.: 13/471,326

(22) Filed: May 14, 2012

(65) Prior Publication Data

US 2013/0298422 A1 Nov. 14, 2013

(51) Int. Cl.
*F26B 11/02* (2006.01)

(52) U.S. Cl.
USPC ..... 34/60; 34/595; 34/610; 68/19; 68/20; 8/142

(58) Field of Classification Search
USPC ..... 34/60, 72, 80, 90, 570, 595, 601, 607, 34/610; 68/5 C, 5 R, 19, 20; 8/139, 142, 8/149, 159
See application file for complete search history.

(56) References Cited

U.S. PATENT DOCUMENTS

| | | | | |
|---|---|---|---|---|
| 3,959,892 | A | 6/1976 | Cloud et al. | |
| 3,969,070 | A | 7/1976 | Thompson | |
| 4,065,253 | A | 12/1977 | Bullock | |
| 4,106,214 | A | 8/1978 | Schmidt | |
| 4,380,126 | A | 4/1983 | Kinder | |
| 4,765,066 | A * | 8/1988 | Yoon | 34/261 |
| 5,036,602 | A | 8/1991 | Coffman | |
| 5,315,765 | A | 5/1994 | Holst et al. | |
| 7,194,823 | B2 * | 3/2007 | Nakamoto et al. | 34/526 |
| 8,042,282 | B2 * | 10/2011 | Oh et al. | 34/595 |
| 8,082,677 | B2 * | 12/2011 | Noviello | 34/60 |
| 2007/0251117 | A1 | 11/2007 | Blount | |
| 2008/0104856 | A1 | 5/2008 | Armstrong | |
| 2009/0100703 | A1 | 4/2009 | Blount | |
| 2009/0272002 | A1 * | 11/2009 | Park et al. | 34/267 |
| 2012/0272689 | A1 * | 11/2012 | Elger et al. | 68/20 |
| 2013/0298422 | A1 * | 11/2013 | Dondurur et al. | 34/570 |

FOREIGN PATENT DOCUMENTS

| | | | | |
|---|---|---|---|---|
| DE | 102008057460 A1 * | 5/2010 | | D06F 58/22 |
| EP | 2431516 * | 3/2012 | | |
| GB | 653173 * | 5/1951 | | |
| JP | 54-108060 | 8/1979 | | |
| JP | 10-113498 | 5/1998 | | |
| WO | WO 2010063564 A1 * | 6/2010 | | D06F 39/08 |

* cited by examiner

*Primary Examiner* — Steve M Gravini
(74) *Attorney, Agent, or Firm* — Richard C. Litman

(57) ABSTRACT

The recirculating dryer includes a housing having an operator control panel and a locking door mounted to a side of the housing. A rotating tumbler for holding the laundry to be dried is mounted inside the housing. Heated air is introduced through an inlet of the tumbler, and the outlet is kept closed by a flap. The heated air is recirculated and recycled through the tumbler. The air is reheated back to a predetermined temperature if the temperature falls below a level suitable for drying. A layer of moisture-absorbent material surrounds the tumbler to absorb the moisture gathered in the air from the drying process. At drying completion, the flap is opened to vent the used air. A control system controls various features with data from a thermostat and a moisture detector.

3 Claims, 3 Drawing Sheets

RECIRCULATING DRYER

BACKGROUND OF THE INVENTION

1. Field of the Invention

The present invention relates to domestic appliances, and particularly to a recirculating dryer that provides high energy efficient drying of laundry.

2. Description of the Related Art

Dryers are widely used in domestic and industrial environments to dry articles of clothing and other laundry. The design of dryers has not changed much since their first introduction. Most traditional dryers continuously draw in ambient air, heat the air, and circulate the heated air through a rotating drum or tumbler containing laundry to be dried. The passage of the heated air through the laundry dries the laundry, and the used air exhausts through an outlet vent to the outside. This is a very effective method of drying wet clothes, but it is very inefficient in terms of energy usage. The used hot air still contains much residual thermal energy that is continuously lost in this process. Unfortunately, most traditional dryers have no means of utilizing or recycling heat energy.

Some efforts have been made to improve energy consumption and usage in dryers. For example, microwave dryers have been introduced that basically use microwave energy to vaporize any moisture in the laundry. While efficient in terms of energy consumption compared to traditional dryers, this type of dryer cannot be used on articles containing metal, such as the buttons on jeans pants and the like, for extended periods of time because of the potential arcing that can occur, which can lead to fires. Thus, microwave drying is typically kept to a minimum, and final drying is performed by convection heating.

Another solution lies in spin dryers. These dryers are simply high rpm (rotations per minute) drums that use centrifugal force to squeeze out moisture. Much like the microwave dryer mentioned above, final drying can be performed by traditional dryers for a net reduction in energy consumption. In some cases, spin dryers are used alone.

Another example utilizes a heat exchanger and condenser integrated into the dryer. In this type of system, the exhaust hot air is circulated through the heat exchanger and cooled by ambient air or water. The water vapor is condensed and drained or collected for later disposal, and the cooled air is fed back into the drying loop. This typical condenser dryer helps reduce accumulation of excess humidity, which can have detrimental effects inside a domicile, e.g., mold. While this type of dryer consumes less energy than traditional dryers, the laundry takes longer to dry because the recirculating air is not as dry as fresh ambient air.

Thus, a recirculating dryer solving the aforementioned problems is desired.

SUMMARY OF THE INVENTION

The recirculating dryer includes a housing having an operator control panel and a locking door mounted to a side of the housing. A rotating tumbler for holding the laundry to be dried is mounted inside the housing. Heated air is introduced through an inlet of the tumbler and the outlet is kept closed by a flap. The heated air is recirculated and recycled through the tumbler. The air is reheated back to a predetermined temperature if the temperature falls below a level suitable for drying. A layer of moisture absorbent material surrounds the tumbler to absorb the moisture gathered in the air from the drying process. At drying completion, the flap is opened to vent the used air. A control system controls various features with data from a thermostat and moisture detector.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
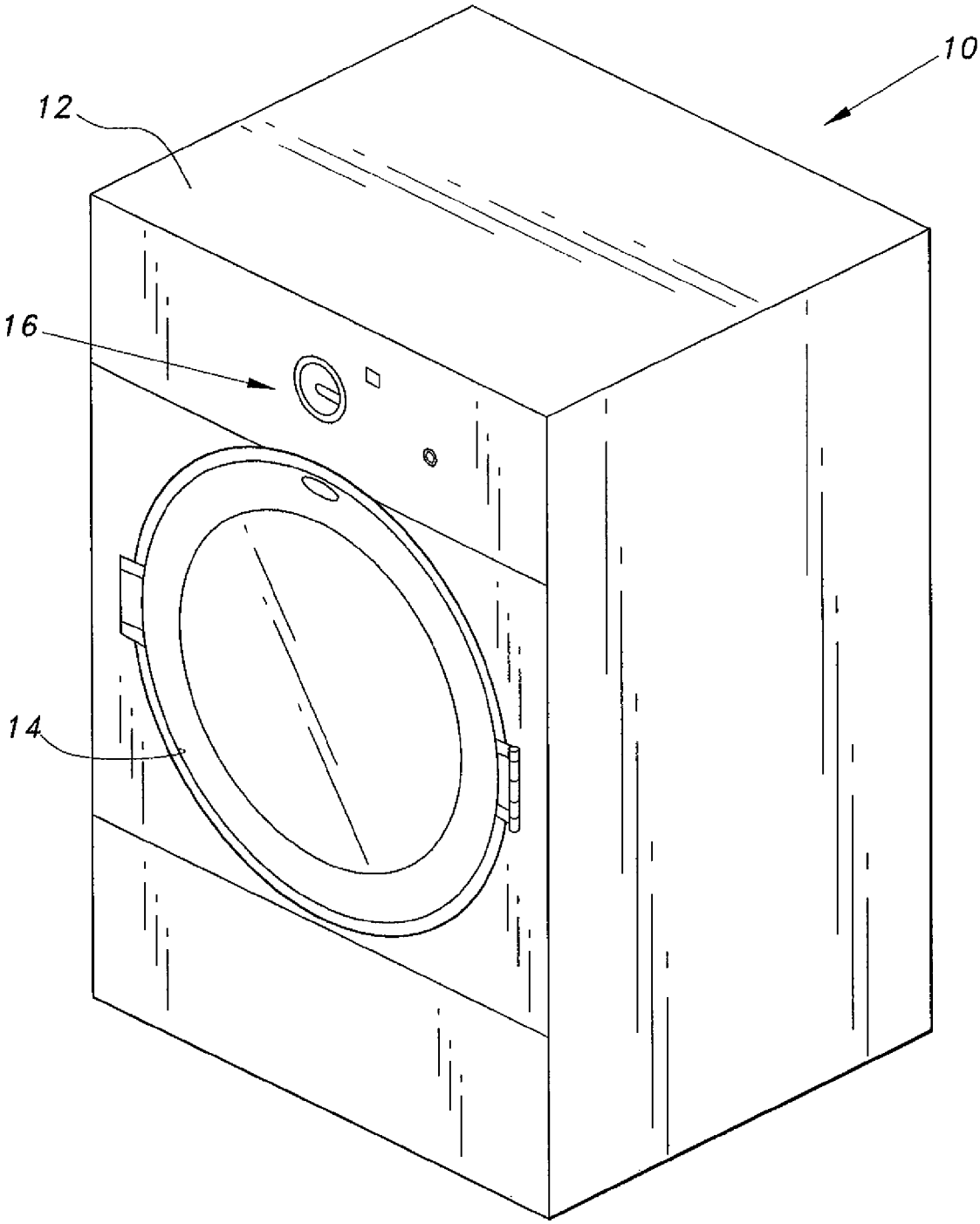
FIG. 1 is a perspective view of a recirculating dryer according to the present invention.

The recirculating dryer, generally referred to by the reference number 10 in the drawings, dries laundry with minimal energy consumption by actively preventing continuous energy loss from continuous venting of the used air. Instead of continuous venting, the used air is recirculated in the drying environment. This results in more efficient use of energy input, e.g., for heating, as well as more efficient use of the potential thermal energy within the used air.

Figure 2:
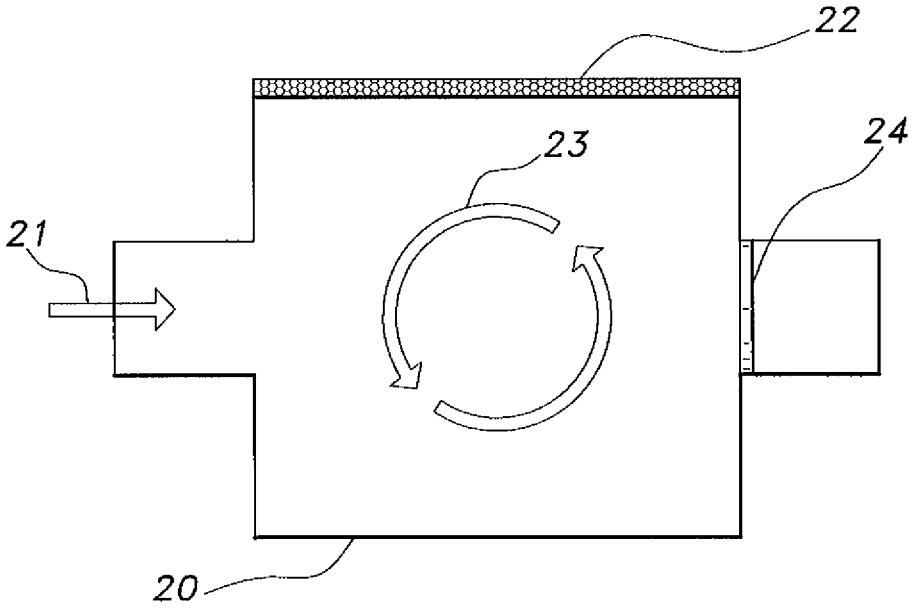
FIG. 2 is a schematic sectional view of the internal mechanisms and airflow therein for the recirculating dryer shown in FIG. 1.
Figure 3:
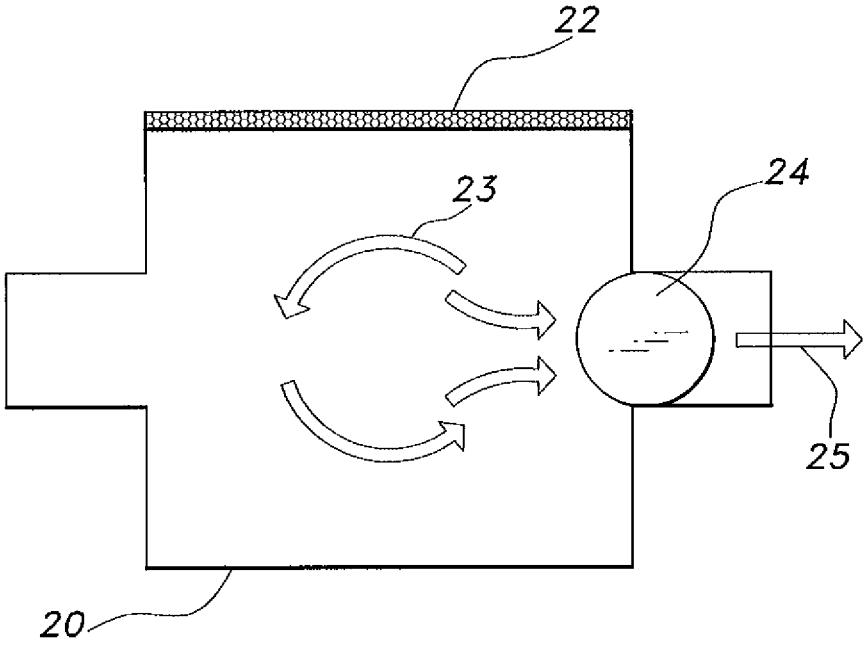
FIG. 3 is another schematic sectional view of the internal mechanisms and venting for the recirculating dryer shown in FIG. 1.

As shown in FIGS. 1-3, the recirculating dryer 10 includes a housing 12 for housing the internal mechanisms of the recirculating dryer 10, a lockable cover or door 14 pivotally mounted to a side of the housing 12, and an operator control panel 16. The housing 12 is preferably box-shaped, but other shapes, such as cylindrical and variations therebetween, can also be used in construction of the housing 12. The door 14 is shown attached to the side of the housing. However, the door 14 can also be installed on top of the housing 12, which may be a more ergonomic and comfortable configuration for those who have difficulty leaning down in order to access the door 14. Moreover, the door 14 can include a transparent window. The operator control panel 16 can be placed at any desired location on the housing, and includes dials, buttons and other mechanical and/or electrical inputs through which the user can set the time and other operating conditions, such as temperature and the type of laundry being dried, e.g., delicate or rugged fabrics. An electronic display can also be provided as a visual interface for operator input.

The interior of the housing 12 includes a rotating drum or tumbler 20 where laundry is placed for drying. The tumbler 20 includes an air inlet end and an air outlet end for introduction and exhaust of the air. Additionally, the tumbler 20 can be provided with a plurality of perforations for the air to escape and funnel into the outlet end. A layer of moisture absorbent layer 22 is placed at select locations around the tumbler 20, over perforations, or all around the tumbler 20. The moisture absorbent layer 22 is preferably constructed from material that is highly absorbent, yet resistant to heat. A variety of different materials can be used for this layer, such as cellulose acetate derivatives, polymers and the like. The moisture absorbent layer 22 can also be placed in an outer drum (not shown) to create an insulating effect. The outlet end includes an actuable gate, flap or vent 24 that remains closed during the majority of the drying cycle.

In use, ambient air is initially heated to a given temperature and introduced into the tumbler 20 as indicated by arrow 21. The flap 24 remains closed. The heated air can be introduced continuously, intermittently, or as needed. Unlike conventional dryers, this air is recycled and recirculated during the drying process in order to take advantage of the latent thermal energy or heat that have not been used to dry the laundry during a single cycle or pass of a volume of air.

As the heated air circulates inside the tumbler 20 (shown by arrows 23), the hot air extracts moisture from the wet laundry, which causes the temperature to drop a certain amount. The drying efficiency of the moisture-laden air diminishes due to the moisture content. To compensate, the moisture is absorbed by the moisture absorbent layer 22 throughout the whole process. When a certain level of moisture has been absorbed, the layer is squeezed of its moisture either from direct centrifugal force from the tumbler 20, by mechanical means (not shown), or manually. The moisture can be collected in a collection bin or drained.

When the temperature drop reaches a predetermined level unsuitable for drying, the recirculating air is reheated back to the initial given level. This process continues until expiration of a timer, or to a user-defined level of dryness. The flap 24 is actuated and the used air is allowed to vent, as indicated by the arrow 25. The lint produced from the drying process can be collected and discarded in a manner well known in the art.

Figure 4:
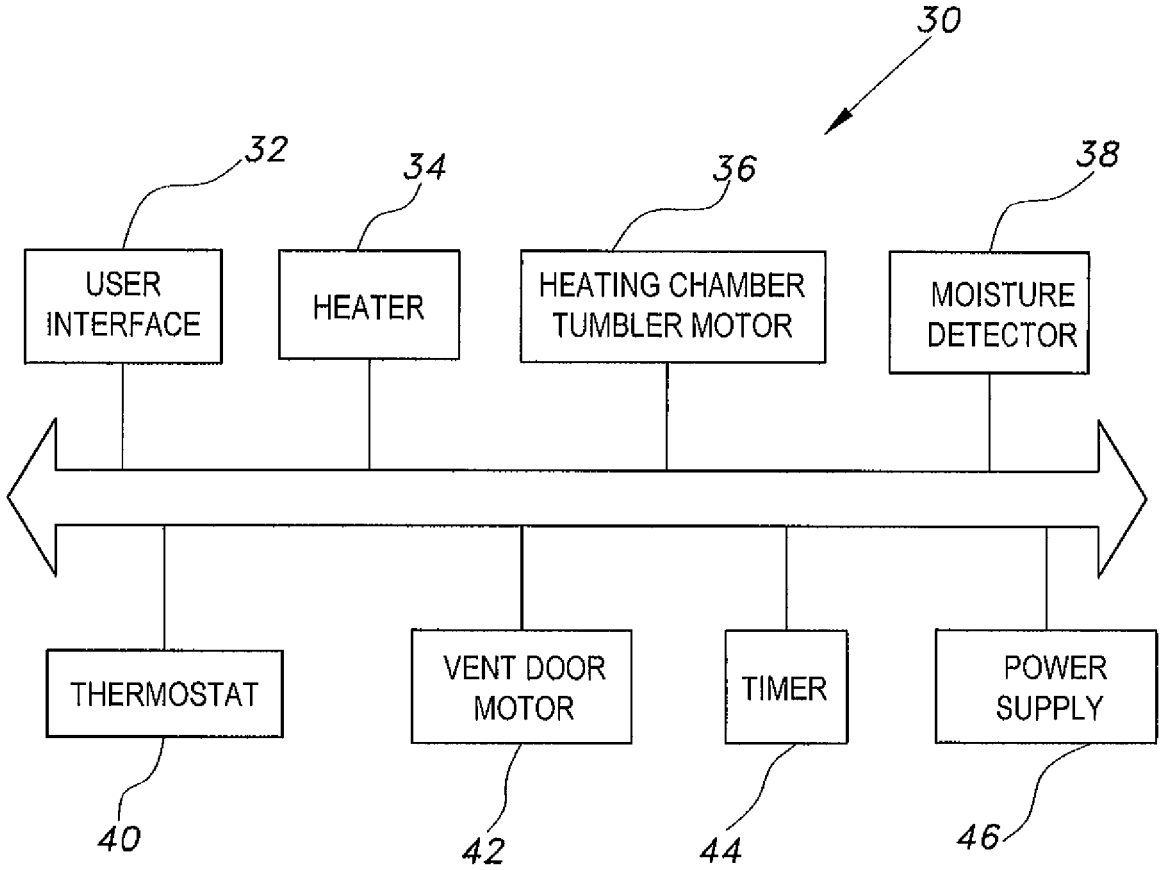
FIG. 4 is a block diagram of the control system for the recirculating dryer of FIG. 1.

The above operations and others are all controlled by the control system 30 operatively connected the operator control panel 16. As shown in FIG. 4, the control system 30 includes a user interface 32, which is the electronic analog of the operator control panel 16. The user interface 32 sets the operating parameters for the recirculating dryer 10, which, based upon the input, sets the timer 44, selective actuation of the heater 34, selective actuation of the tumbler motor 36 and selective actuation of the vent motor 42 to open or close the flap 24. The control system 30 can also be programmed to control usage and duration of the power supply 46 as another energy saving measure.

Unlike traditional dryers, the recirculating dryer does not continuously heat the ambient air supply, especially not the air recirculating during the drying process. This substantially reduces energy demand because the amount of energy required to heat the already heated air back to the predetermined level is much less than heating ambient air being continuously fed into the tumbler 20, since the temperature differential is much smaller.

In order to properly determine when additional heating is required or to determine the amount of moisture within the tumbler 20, the control system 30 includes a thermostat 40 for monitoring temperatures and a moisture detector 38 for monitoring the moisture content. The data from these sensors insure that the heater 34 is operating only when needed in order to minimize energy usage, and to determine whether the moisture-absorbent layer 22 is operating at capacity. In the case of the latter, such data can also help determine the necessity of maintenance and/or replacement.

Thus, it can be seen that the recirculating dryer 10 is highly energy efficient, both with the energy required to operate and the energy used in the drying process. The control system 30 insures that only the required amount of energy is being used to heat the air and rotate the tumbler 20. Instead of venting all the hot air passing through the tumbler 20, the hot air is recirculated and reheated as needed, which maximizes the use of thermal energy. The absorbent layer 22 insures that moisture within the drying system is kept to a minimum so that it will not impact drying efficiency.

It is to be understood that the present invention is not limited to the embodiments described above, but encompasses any and all embodiments within the scope of the following claims.

We claim:

1. A recirculating dryer, comprising:

a housing having a hollow interior;

an operator control panel disposed on the housing;

a lockable door mounted to a side of the housing, the door being selectively openable to access the interior of the housing;

a rotatable tumbler disposed inside the housing, the tumbler being adapted for holding laundry to be dried, the tumbler having an air inlet and an air outlet;

a selectively actuable flap mounted to the air outlet, the flap being movable into an open or closed position to open or close the air outlet;

a moisture-absorbent layer surrounding the tumbler, the moisture-absorbent layer absorbing moisture from heated air during drying; and a heater operably connected to the tumbler, the heater being selectively operable to heat air to a selectable drying temperature;

wherein during drying, the flap is closed to allow the heated air to recycle and recirculate through the tumbler in order to minimize energy for heating the air and rotating the tumbler, thereby efficiently using thermal energy from the heated air.

2. The recirculating dryer according to claim 1, further comprising a control system for controlling drying of laundry, the control system being operatively connected to said heater, the control system having:

a user interface, the user interface being an electronic analog of said operator control panel;

a thermostat for monitoring temperature in said tumbler;

a timer;

a moisture detector for monitoring moisture content in said tumbler;

a tumbler motor for rotating said tumbler; and a vent motor for opening and closing said flap in order to selectively operate said heater, the tumbler motor and the vent motor based upon data from the user interface, the thermostat, and the moisture detector.

3. An energy efficient method of drying laundry, comprising the steps of:

providing a recirculating dryer as in claim 1;

heating ambient air to a predetermined temperature, the predetermined temperature being higher than a laundry drying temperature;

closing said flap in order to prevent air and thermal energy loss;

feeding the heated air into said tumbler;

recirculating and recycling the heated air in said tumbler, the heated air gathering moisture from the laundry, causing the predetermined temperature to fall below the drying temperature;

absorbing moisture from the heated air with said moisture-absorbent layer to maintain dryness of the heated air;

reheating the heated air with said heater to raise the temperature of the heated air back to the predetermined temperature; and opening said flap to exhaust used air upon completion of a drying cycle.

* * * * *